United States Patent [19]

Wada

[11] Patent Number: 4,471,816

[45] Date of Patent: Sep. 18, 1984

[54] OPTICAL WEFT SENSOR FOR A LOOM

[75] Inventor: Yoshimi Wada, Higashiyamato, Japan

[73] Assignee: Nissan Motor Company, Limited, Yokohama, Japan

[21] Appl. No.: 420,844

[22] Filed: Sep. 21, 1982

[30] Foreign Application Priority Data

| | | | |
|---|---|---|---|
| Sep. 25, 1981 | [JP] | Japan | 56-150736 |
| Sep. 25, 1981 | [JP] | Japan | 56-150737 |
| Nov. 20, 1981 | [JP] | Japan | 56-171978 |
| Jun. 9, 1982 | [JP] | Japan | 57-97560 |

[51] Int. Cl.[3] ..... D03D 51/34; G01N 21/89

[52] U.S. Cl. ..... 139/370.2; 250/227; 250/561; 250/571

[58] Field of Search ..... 139/370.2, 370.1; 250/559, 561, 571, 227

[56] References Cited

U.S. PATENT DOCUMENTS

| | | | |
|---|---|---|---|
| 3,824,401 | 7/1974 | Suzuki | 139/370.1 X |
| 3,853,408 | 12/1974 | Kaalverink | 139/370.2 X |
| 3,978,893 | 9/1976 | Inagawa et al. | 139/370.2 |
| 4,067,365 | 1/1978 | Gotoh . | |
| 4,085,777 | 4/1978 | Dadak et al. . | |
| 4,150,699 | 4/1979 | Suekane . | |
| 4,188,981 | 2/1980 | Suekane et al. . | |
| 4,384,596 | 5/1983 | Brouwer et al. | 139/370.2 |

FOREIGN PATENT DOCUMENTS

| | | | |
|---|---|---|---|
| 2105559 | 8/1972 | Fed. Rep. of Germany . | |
| 2355109 | 1/1978 | France . | |
| 2355108 | 1/1978 | France . | |
| 7602260 | 9/1976 | Netherlands . | |
| 485055 | 3/1970 | Switzerland | 139/370.2 |
| 488039 | 5/1970 | Switzerland . | |
| 1236346 | 6/1971 | United Kingdom . | |

*Primary Examiner*—James Kee Chi

*Attorney, Agent, or Firm*—Schwartz, Jeffery, Schwaab, Mack, Blumenthal & Koch

[57] ABSTRACT

An optical weft sensor for a loom in which the light-receiving and light receiving elements are fixed to the loom frame and only the flexible optical fibers are disposed on the reed frame. Since no shock or vibration is applied to these electronic elements, it is possible to obtain a relatively long life time, thus improving the sensor reliability. Additionally, since the weft sensor according to the present invention is supported by a sensor holder, it is possible to readily adjust the sensor position along the reed frame or reed holder when the width of the cloth is required to change. The optical weft sensor comprises a LED, a phototransistor, optical fibers, and a detection circuit, in addition to the sensor holder.

11 Claims, 22 Drawing Figures

FIG.16
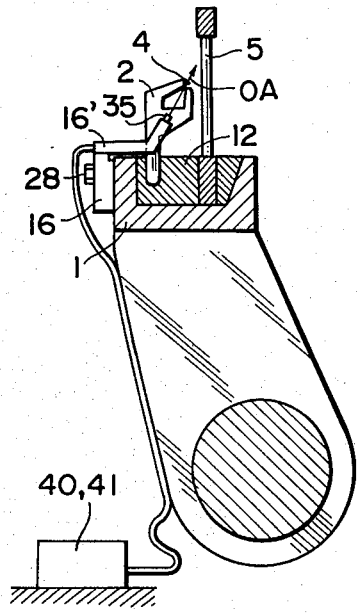
FIG.17
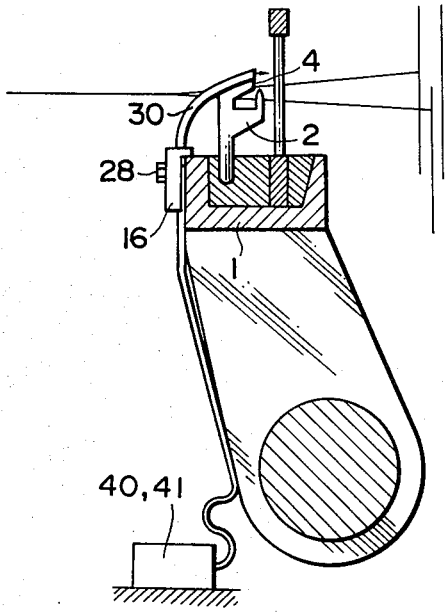
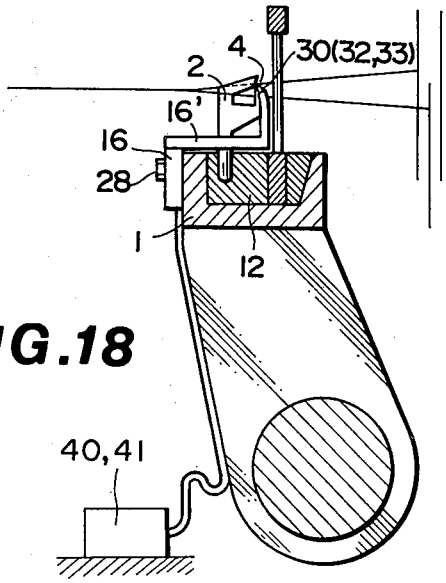
FIG.18

OPTICAL WEFT SENSOR FOR A LOOM

BACKGROUND OF THE INVENTION

1. Field of the Invention

The present invention relates generally to an optical weft sensor for a loom and more specifically to the installation position or installation method of an optical weft sensor for use with a fluid-jet loom.

2. Description of a Prior Art

As is well known, an optical weft sensor is provided for a fluid-jet loom (air-jet loom or water-jet loom) in order to optically detect that a weft thread is securely inserted into fluid-guide plates having a fluid-guide opening and a weft-removing slot, respectively, and arranged in the direction of weft insertion. The optical weft sensor comprises a light-emitting section and a light-receiving section for detecting the presence or absence of weft depending upon the change in magnitude of the received light, which is caused when a weft removed through the weft-removing slot of the fluid-guide plate passes across an optical axis formed between the light-emitting section and the light-received section during the beat-up stage.

In the prior-art optical weft sensor, however, there exist some problems or shortcomings as follows:

1. Since the light-emitting element (e.g. diode) and the light-receiving element (e.g. phototransistor) are disposed on the fluid-guide plates or fixed to a certain position on the reed frame, shock or vibration caused by the oscillating reed is inevitably applied to the light-emitting element and the light-receiving element, thus resulting in a problem in that these electronic elements may easily be damaged.

2. since the presence or absence of the weft is detected depending upon the instantaneous change in magnitude of the received light caused when a weft is removed through the weft-removing slot, the weft detection time period is short, thus resulting in a problem in that it is difficult to discriminate an optical signal due to weft from that due to fluff; that is, there exist erroneous detections;

3. since the optical weft sensor is mounted near the weft-removing slot of one of the fluid-guide plates, the optical weft sensor is sometimes brought into contact with the weft removed through the weft-removing slot at the beat-up stage and therefore pushes the removed weft toward the cloth fell, thus resulting in a problem in that the weft vibrated by the sensor applies undesirable vibrations to the selvedge (leno) yarns and catch-cord yarns; that is, there exist wale streak and misscatching of weft;

4. since the optical weft sensor is directly mounted on or in one of the fluid-guide plates or between two of the fluid-guide plates, thus resulting in a problem in that when the width of woven cloth is required to change, the setup work is troublesome and takes much preparatory time.

A more detailed description of the prior-art optical weft sensor for a fluid-jet loom will be made with reference to the attached drawings under DETAILED DESCRIPTION OF THE PREFERRED EMBODIMENTS.

SUMMARY OF THE INVENTION

With these problems in mind therefore it is the primary object of the present invention to provide an optical weft sensor for a fluid-jet loom such that it is possible to prevent the light-emitting and light-receiving elements from receiving shock or vibration caused by the oscillating reed, to obtain a relatively long detection time period, to prevent the weft from being brought into contact with some part of the optical weft sensor, and to readily adjust the position of the weft sensor when the width of woven cloth is required to change.

To achieve the above-mentioned object, in the optical weft sensor according to the present invention, the light-emitting and light-receiving elements are disposed on an appropriate position of the loom frame and only the flexible optical fibers are arranged along the sley sword; the optical axis perpendicular to the end open surface of a bundle of the optical fibers is set so as to point at a position where the weft removed from the fluid-guide plates is in contact with the reed wires at at-least end stage of the weft beat-up motion; the optical fibers are disposed out of a range within which the weft is relatively moved with respect to the reed at the beat-up stage; the sensor holder is fixed to the reed frame or the reed holder in such a way that the optical sensor can readily be adjusted along the longitudinal direction of the reed holder when the cloth width is required to change.

The optical weft sensor for a loom according to the present invention comprises light emitting means, light receiving means, at least one light-emitting fiber and light-receiving fiber connected to the light emitting and receiving means optically, optical signal processing means for processing the received light to stop the loom in case a weft is not inserted into the shed, and sensor holding means for holding said optical fibers in such a direction that the optical axis thereof points at a position where the weft is in contact with the reed wires at the start or end stage of the weft beat-up motion.

BRIEF DESCRIPTION OF THE DRAWINGS

The features and advantages of the optical weft sensor for a loom according to the present invention will be more clearly appeciated from the following description taken in conjunction with the accompanying drawings in which like reference numerals designate corresponding elements or sections throughout the drawings and in which;

FIG. 16 is a partially sectional diagramatic side view of the essential portion of a reed, at which the fifth embodiment of the optical weft sensor according to the present invention is mounted;

FIG. 17 is a partially sectional diagramatic side view of the essential portion of a reed, at which the sixth embodiment of the optical weft sensor according to the present invention is mounted.

FIG. 18 is a partially sectional diagramatic side view of the essential portion of a reed, at which a seventh embodiment of the optical weft sensor according to the present invention is mounted.

DETAILED DESCRIPTION OF THE PREFERRED EMBODIMENTS

To facilitate understanding of the present invention, a brief reference will be made to prior-art optical weft sensors with respect to their application to an air-jet loom, with reference to the attached drawings.

Figure 1:
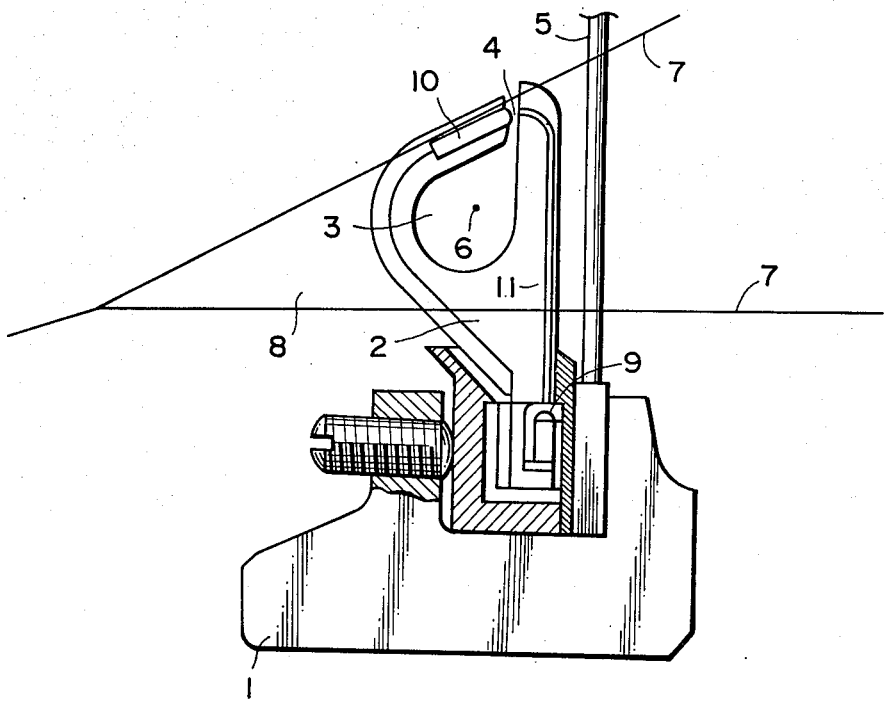
FIG.1 PRIOR ART
FIG. 1 is a partially sectional diagramatic side view of an air-guide plate provided with a prior-art optical weft sensor for an air-jet loom.

FIG. 1 shows a prior-art optical sensor for use in an air-jet loom. In the figure, the reference numeral 1 denotes a reed holder, the reference numeral 2 denotes one of a plurality of air-guide plates having a series of air-guide opening 3 and weft-removing slots 4. The reference numeral 5 denotes a reed. The reed holder 1, air-guide plates 2 and reed 5 oscillate together. Further, the reference numeral 6 denotes a weft thread inserted into the air-guide opening 3, the reference numeral 7 denotes warp threads, and the reference numeral 8 denotes a shed formed between the warp threads 7. In FIG. 1, an optical weft sensor comprises a light-emitting element 9 such as an LED mounted on the bottom of an air-guide plate, a light-receiving element 10 such as a phototransistor mounted near the weft-removing slot 4, and a light-transmitting element 11 such as an optical fiber attached to the air-guide plate 2.

The presence or absence of the weft 6 can be detected, when the weft 6 passes through the slot 4 at the beat-up stage and therefore the weft shuts out the light emitted from the light-emitting element 9 to the light-receiving element 10.

In such a prior-art optical weft sensor as described above, however, since the light-emitting and light-receiving element are disposed on the fluid-guide plates, shock or vibration caused by the oscillating reed is inevitably applied to the elements and therefore the life time is short. Further, since the presence or absence of the weft is detected depending upon the change in magnitude of light caused when the weft passes through the slot 4, the weft-detecting time period is extraordinarily short. As a result, if there exists fluff or waste thread in the slot, there arises a problem in that the weft is often detected erroneously. Furthermore, since the optical sensor unit is mounted on one of the air-guide plates 2, when the width of woven cloth is required to change, the setup work for rearranging the air-guide plate including the optical weft sensor is relatively complicated and troublesome.

Figure 2:
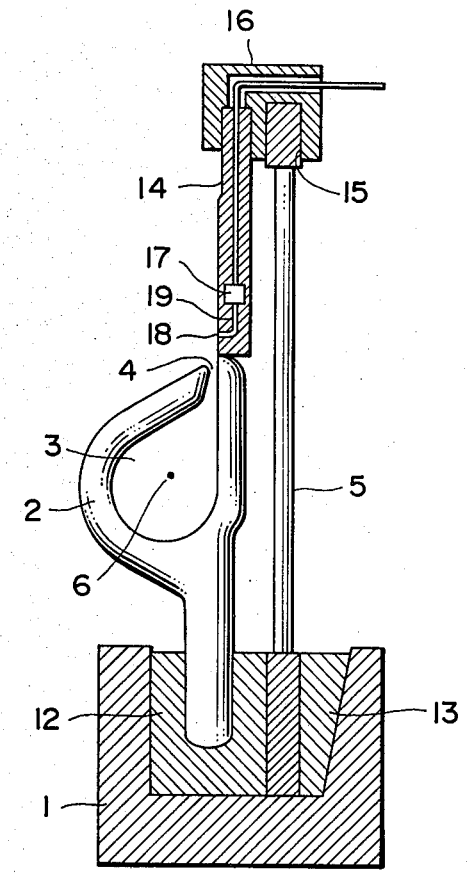
FIG. 2 PRIOR ART
FIG. 2 is a partially sectional diagramatic side view of another air-guide plate and another prior-art optical weft sensor for an air-jet loom.

FIG. 2 shows another prior-art optical sensor for use in an air-jet loom. In this prior-art, the reed 5 is fixed to the reed holder 1 being sandwiched between an air-guide plate holder 12 and a wedge 13. Further, the sensor section 14 is fixed to a reed frame 15 by the aid of a sensor holder 16. The sensor section 14 includes a sensor head 17 in which a light-emitting element and a light-receiving element are housed. The light emitted from the sensor head 17 is reflected from the weft 6, when the weft passes through the slot 4 and near the open end surface 18 of a bundle of a plurality of optical fibers 19. The light reflected from the weft 6 is then received through the same open end 18 of a bundle of the optical fibers 19.

Figure 3:
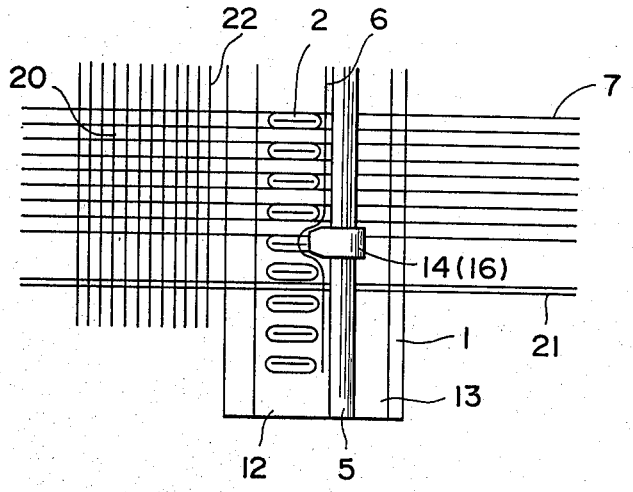
FIG.3 PRIOR ART
FIG. 3 is a fragmentary top view of the apparatus shown in FIG. 2, for assistance in explaining the shortcomings of the prior-art optical weft sensor.

FIG. 3 shows the top view of FIG. 2, in which the woven cloth 20 is illustrated together with a plurality of warp threads 7 and catch-cord yarns 21. Further, the reference numeral 22 denotes the cloth fell.

In such a prior-art optical weft sensor as described above, the leading end of the weft 6 jetted from an air-jet nozzle (not shown) is selvaged by leno yarns and further caught by catch-cord yarns 21; however, at the beat-up stage, the outer surface of the sensor section 14 often pushes the weft 6 inserted into the air-guide plate and then removed through the slot toward the cloth fell 22, as depicted in FIG. 3. Therefore, the leno yarns and the catch-cord yarns are readily oscillated by the weft 6 vibrated by the sensor 14, which raises a problem in that wale streak is easily produced on the woven cloth side opposite to the weft picking side or the weft is not securely caught by the catch-cord yarns 21.

In view of the above description, reference is now made to a first embodiment of the optical weft sensor for a loom according to the present invention.

Figure 4:
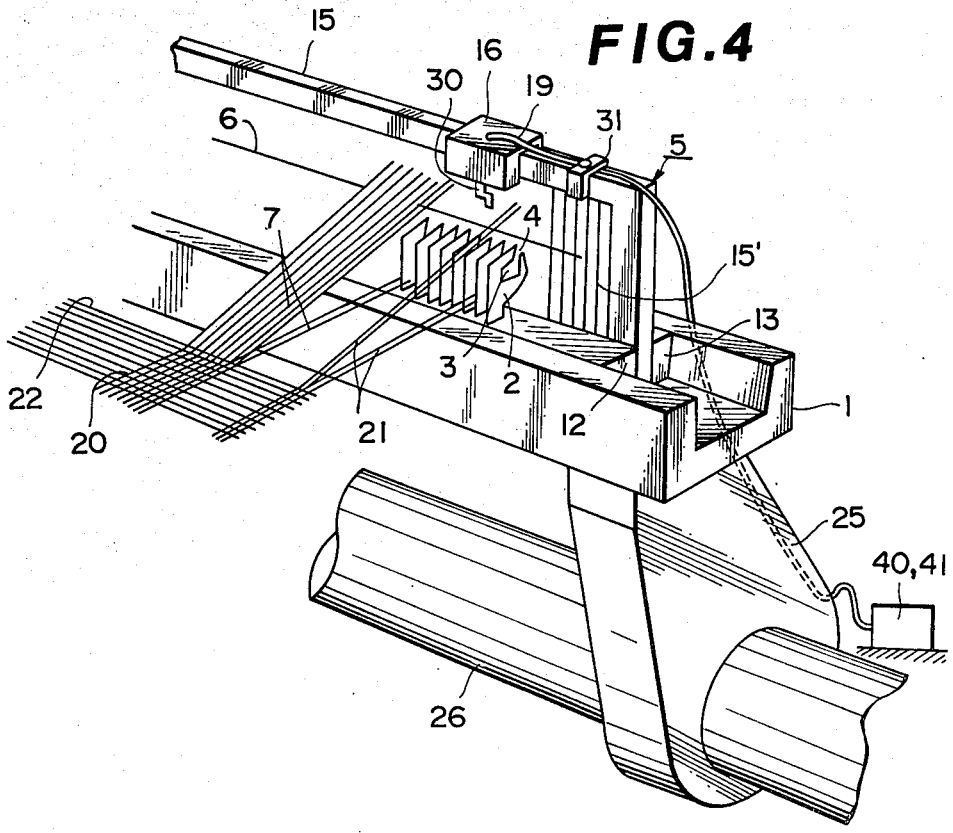
FIG. 4 is a perspective view of the essential portion of a reed, at which a first embodiment of the optical weft sensor according to the present invention is mounted.
Figure 5:
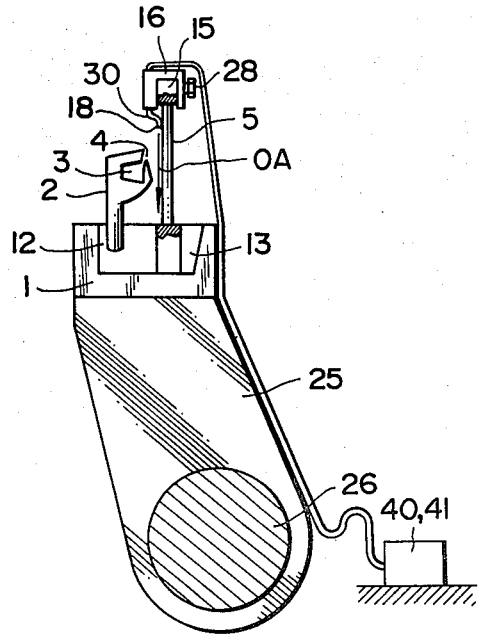
FIG. 5 is a partially sectional diagramatic side view of the essential portion of a reed, at which the first embodiment of the optical weft sensor according to the present invention shown in FIG. 4 is mounted.

In FIGS. 4 and 5, a reed holder 1 is mounted on a sley sword 25 fixed to a sley sword shaft 26. The reed 5 is fixed to the reed holder 1 being sandwiched between an air-guide holder 12 and a wedge 13. A plurality of air-guide plates 2 having an air-guide opening 3 and a weft-removing slot 4 respectively are fixed by a bonding agent to the air-guide holder 12 being arranged in the weft direction. Further, in FIG. 4, the reference numeral 6 denotes a weft, the reference numeral 7 denotes a plurality of warp threads, the reference numeral 21 denotes a catch-cord yarns, the reference numeral 20 denotes a woven cloth, and the reference numeral 22 denotes cloth fell.

A U-shaped optical weft sensor holder 16 is mounted on top of a reed frame 15 and between the warp threads farmost from and opposite to the weft picking side and the catch-cord yarn 21 with a bolt 28 (shown in FIG. 5).

A bundle of light transmitting and receiving optical fibers 30, connected optically to a light-emitting element such as a light-emitting diode and a light-receiving element such as a phototransistor, is first fixed by a fixture 31 to the top portion of the reed frame 15 and then passed through a through hole formed in the sensor holder 16, being disposed near one of the reed wires 15' after having been bent at an appropriate angle, the open end 18 of which faces downward and the optical axis OA of which is in parallel with the reed wires 15'.

As depicted in FIGS. 4 and 5, the light-emitting element such as a light-emitting diode 40 and the light-receiving element such as a phototransistor 41 are fixed within an appropriate circuit housing mounted on the loom frame. The fiber bundle 30 is arranged along the top portion of the reed frame 15 and along the sley sword 25 extending to near the center of the sley sword shaft 26. Therefore, when the reed 5 oscillates with the sley sword shaft 26 as its center, no shock or vibration is applied to the light-emitting diode 40 and the phototransistor 41. Further, since the optical fiber bundle 30 is separated from the sley sword 25 near its oscillating center, it is possible to minimize the oscillation stoke of the optical fiber bundle 30.

Figure 6:
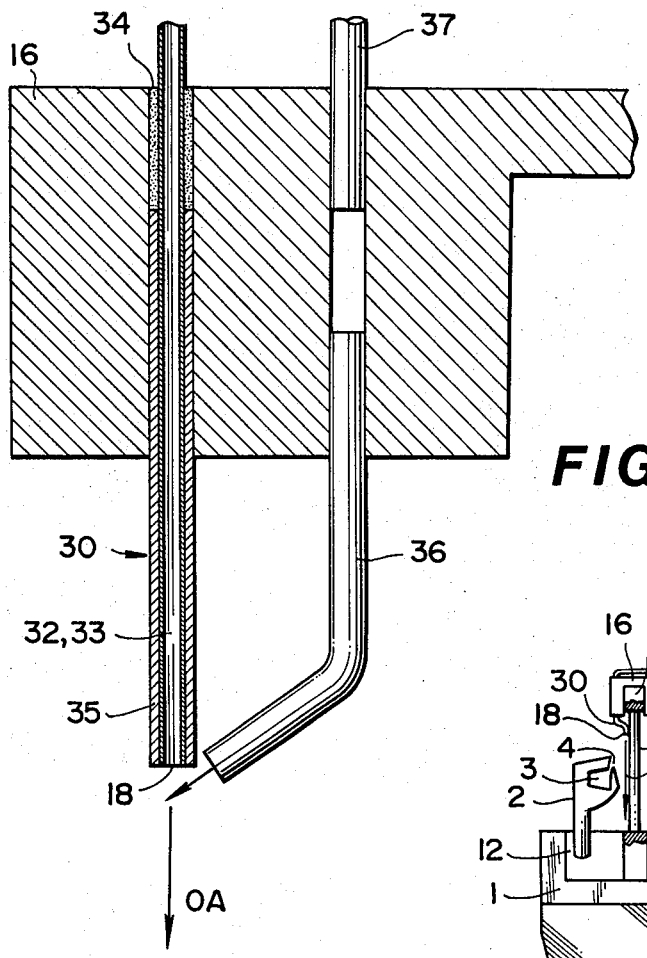
FIG. 6 is an enlarged detailed sectional view of a bundle optical weft sensor fibers and a sensor holder of the first embodiment of the optical weft sensor according to the present invention.
Figure 7:
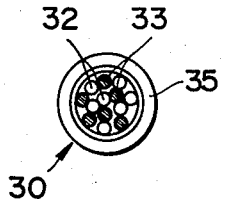
FIG. 7 is an enlarged detailed bottom view of the open end surface of a bundle of optical fibers to transmit the emitting light and the received light for use in the first embodiment according to the present invention.

FIGS. 6 and 7 show the structure of this light transmitting and receiving optical fibers 30 in more detail. A plurality of light-transmitting optical fibers 32 and light-receiving optical fibers 33 are collected into a single optical fiber bundle 30 as depicted in FIG. 7. The optical fiber bundle 30 is first passed through a resin collar 34 fitted to a hole of the sensor holder 16 and next passed through a metal pipe 35. Further, in FIG. 6, the reference numeral 36 denotes an air nozzle connected to an air supply source (not shown) via an air pipe 37 in order to prevent fluff from sticking onto the open end surface 18 of the optical fiber bundle 30.

Figure 8:
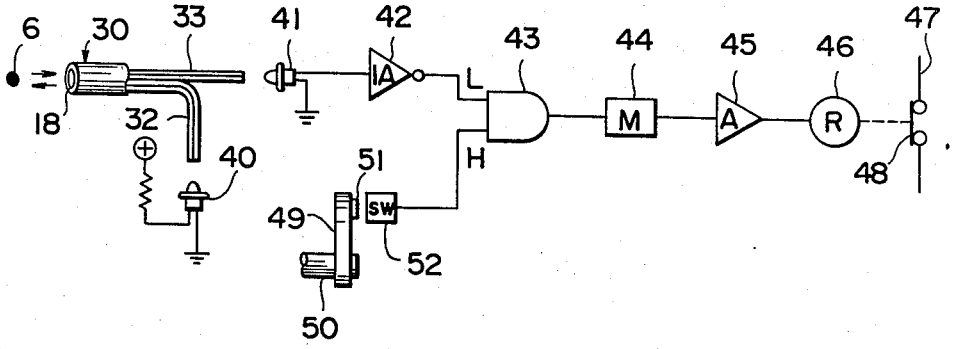
FIG. 8 is a schematic circuit block diagram for use in the optical weft sensor according to the present invention.
Figure 9:
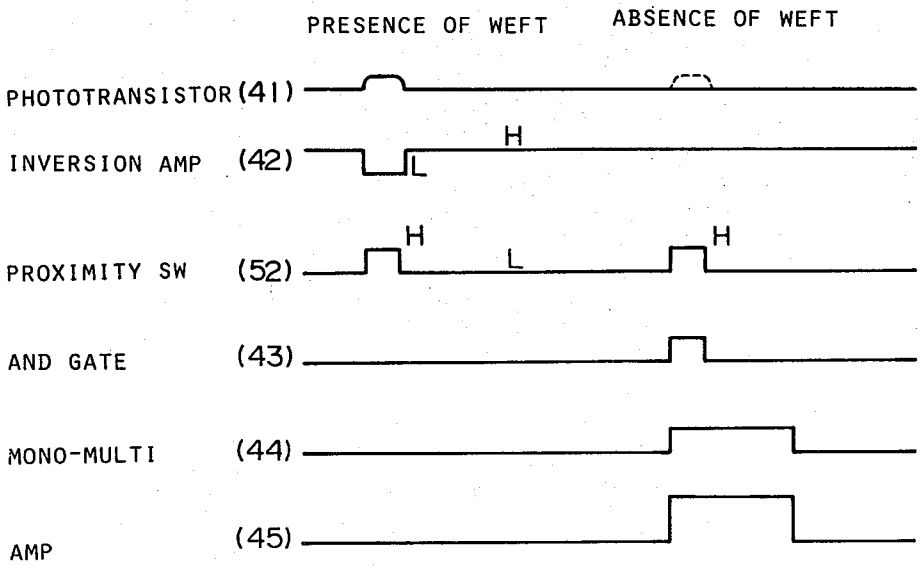
FIG. 9 is a timing chart which shows each waveform at the essential sections of the circuit block diagram of FIG. 8.

With reference to FIGS. 8 and 9, the circuit configuration of the weft sensor according to the present invention will be described hereinbelow.

A sensor light emitted from a light-emitting element (LED) 40 is transmitted through a plurality of light-emitting optical fibers 32 and emitted from the open end surface 18 of the bundle 30 of the optical fibers. The light reflected from the weft 6 is transmitted through a plurality of light-receiving optical fibers 33 and received by a light-receiving element (phototransistor) 41. The light signal indicative of the presence of weft received by the light-receiving element 41 is amplified and inverted via an inversion amplifier 42 in order to output a L-voltage level signal to one of two input terminals of an AND gate 43.

On the other hand, a proximity switch 52 is connected the other of the two input terminals of the AND gate 43. This proximity switch 52 outputs a H-voltage level signal when a metal member 51 comes near to the proximity switch 52. The metal member 51 is fixed to an arm 49 and rotates around a shaft 50 in synchronization with the movement of the loom. The proximity switch 52 is so designed as to output a H-voltage signal only while the reed wires are at the beat-up stage.

Accordingly, when the inversion amplifier 42 outputs a L-voltage level signal indicative of the presence of weft, even if the proximity switch 52 outputs a H-voltage level signal at the beat-up stage, no H-voltage level signal is outputted from the AND gate 43. However, when the inversion amplifier 42 outputs a H-voltage level signal indicative of the absence of weft, whenever the proximity switch 52 outputs a H-voltage level signal at the beat-up stage, a H-voltage level signal is outputted from the AND gate 43. The H-voltage level signal from the AND gate 43 is given to a monostable or one-shot multivibrator 44 in order to output a pulse signal with a sufficient pulse width. The pulse signal is then amplified via an amplifier 45, and given to a relay 46 in order to break a normally-closed contact 48, so that the loom is stopped in response to the H-voltage level signal from the AND gate 43, indicating the absence of weft 6. These relationships between respective circuit elements can well be understood with reference to the timing chart shown in FIG. 9.

Figure 10A:
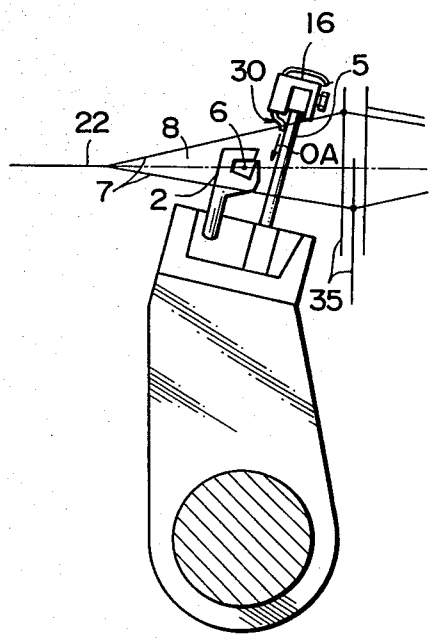
FIG. 10(A) is a diagramatic side view of the essential portion of a reed and the first embodiment of the optical weft sensor according to the present invention, in which the reed is positioned at the rearmost position.
Figure 10B:
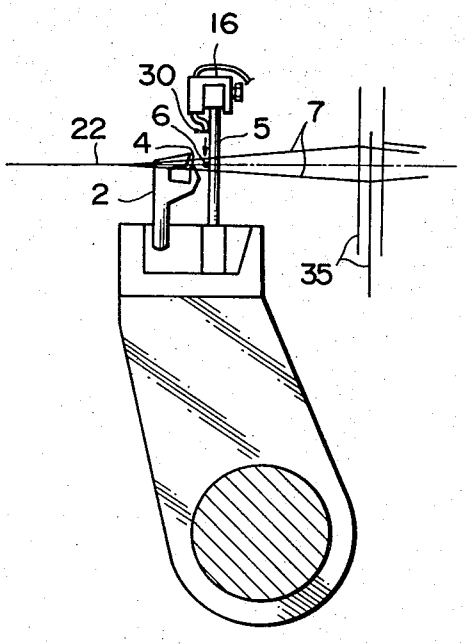
FIG. 10(B) is the same side view as in FIG. 10(A), in which the reed wire is in contact with a weft.
Figure 10C:
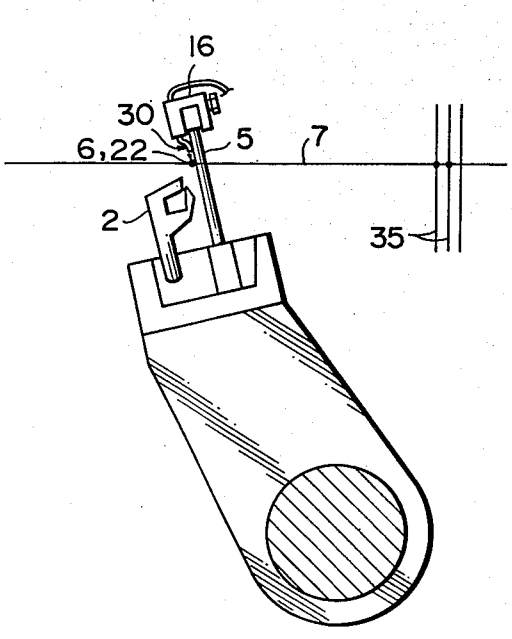
FIG. 10(C) is the same side view as in FIG. 10(A), in which the reed is positioned at the frontmost position.

FIGS. 10(A) to 10(C) show the mutual positions of the reed 5, air-guide plates 2, warp threads 7, weft 6, etc. Further, in the figure, the reference numeral 35 denotes a heald to give an opening movement to the warp threads 7.

In FIG. 10(A), when the reed 5 is moved to the rearmost position, the air-guide plates 2 are advanced into the shed 8 formed between warp threads 7 and a weft 6 is inserted into the opening of the air-guide plates 2.

After the weft 6 has been inserted into the shed, as shown in FIG. 10(B), the reed 5 moves frontward (leftward in FIG. 10(*c*)) for performing beat-up motion. In this case, however the weft is first removed through the weft-removing slot 4 of the air-guide plate 2 and is brought into contact with the reed wires 15' of the reed 5. When the reed 5 further moves frontward, the weft 6 is moved by the reed 5 and is beaten up to the cloth fell 22 as shown in FIG. 10(C).

As shown in FIGS. 10(B) and 10(C), since the weft 6 is positioned on the optical axis OA of the optical fiber bundle 30 while the weft 6 is in contact with the reed 5, the light emitted from the open end surface 18 of the optical fibers 30 is reflected from the weft and is received by the same open end surface 18, so that the presence of weft 6 is detected.

In contrast with this, in the case of absence of the weft 6, the light emitted from the optical fiber 30 is diffusion-reflected from the lower side of the reed 5 and is not received by the optical fiber bundle 30. In this case, it is preferable to form a rough surface on the lower side of the reed 5 to increase diffusion reflection. Since a H-voltage level signal is kept outputted from the inversion amplifier 42, when the proximity switch 52 outputs a H-voltage signal, the ANDed signal via the AND gate 43 is given to the relay 46 through the one-shot multivibrator 44 and the amplifier 45 to break the contact 48, so that the loom is stopped.

As is well understood from FIGS. 10(B) and 10(C), since the time when the weft is in contact with the reed wire is relatively longer than in the prior-art weft sensor in which the weft passes through the weft-removing slot momentarily, it is possible to obtain a long weft detection time period, that is, to improve the reliability in detecting the presence of the weft.

Further, when the width of woven cloth is required to change, since it is possible to easily move the sensor holder 16 along the top portion of the reed frame 15 to an appropriate sensor position between the warp threads farmost from and opposite to the weft picking side and the catch-cord yarns, without adjusting the air-guide plate position, the setup work (preparatory work for the loom) is simple without taking much time.

Further, since the weft 6 removed through the slot 4 of the air-guide plate 2 is not in contact with the optical fiber 30 or the sensor holder 16, the weft 6 is not vibrated by the optical sensor or the reed 5.

Furthermore, in this first embodiment, an air nozzle 36 (shown in FIG. 6) is additionally provided for preventing fluff sticking onto the open end surface 18 of optical fiber bundle 30; however, if the open end surface 18 of the optical fiber bundle 30 is so fixed as to be brought into contact with the weft before the beat-up motion has been completed, it is possible to prevent fluff from sticking onto the open end surface 18 of the optical fiber bundle 30.

Figure 11:
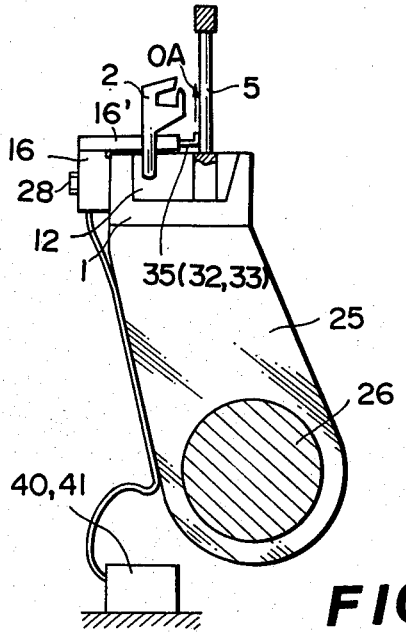
FIG. 11 is a partially sectional diagramatic side view of the essential portion of a reed, at which the second embodiment of the optical weft sensor according to the present invention is mounted.

FIG. 11 shows a second embodiment of the optical weft sensor according to the present invention. In this embodiment, the sensor holder 16 is fixed to the front side surface of the reed holder 1 with a bolt 28.

The projection portion 16' connected integrally to the sensor holder 16 is passed through between the two air-guide plates 2 extending along the top surface of the air-guide holder 12 and to near the reed wires.

The bundle of light emitting and receiving optical fibers 30 is passed through a hole formed in the sensor holder 16 and the projection 16' being protected by a metal pipe 35, with the open end surface of the optical fiber bundle facing upward and with the optical axis OA preset in parallel with the reed wires.

Therefore, the light emitted from the light emitting fibers 32 is reflected from a weft which is in contact with the reed wires and is received by the light receiving fibers 33, so that the presence or absence of weft is detected.

The operation of this second embodiment is quite the same as in the first embodiment, which has already been explained with reference to FIGS. 8, 9, and 10.

In this second embodiment, since the time when the weft is in contact with the reed wire is relatively longer than in the prior-art weft sensor by which the weft is detected when passing through the weft-removing slot momentarily, it is possible to obtain a long weft detection time period.

Further, when the width of woven cloth is required to change, since it is possible to easily remove the sensor holder 16 and set it again to an appropriate position between the warp threads farmost from and opposite to the weft picking side and the catch-cord yarns, without adjusting the air-guide plates, the setup work is simple.

Figure 12:
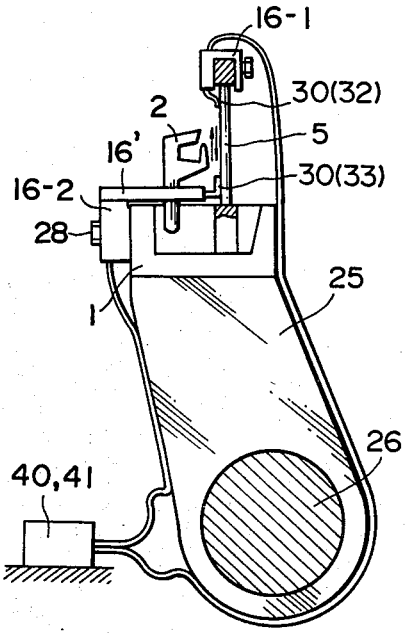
FIG. 12 is a partially sectional diagramatic side view of the essential portion of a reed, at which the third embodiment of the optical weft sensor according to the present invention is mounted.

FIG. 12 shows a third embodiment of the optical weft sensor according to the present invention. In this embodiment, the sensor holder 16 is divided into two holders 16-1 and 16-2. A bundle of light-emitting optical fibers 32 is held by the first sensor holer 16-1; a bundle of light-receiving optical fibers 33 is held by the second sensor holder 16-2. In FIG. 12, the sensor light is emitted from the upper fiber bundle 32 to the lower fiber bundle 33; however, it is of course possible to emit the sensor light from the lower fiber bundle 33 to the upper fiber bundle 32.

As depicted in FIG. 12, the light-emitting element such as a light-emitting diode 40 and the light-receiving element such as a phototransistor 41 are fixed within an appropriate circuit housing mounted on the loom frame as in the first and the second embodiments. In this embodiment, however, two separate fiber bundles are arranged along different routes on and along the sley sword 25 extending to near the center of the sley sword shaft 26.

In this embodiment, it is necessary to align two optical axes of the light emitting fibers 32 and the light receiving fibers 33 by adjusting the two sensor holders 16-1 and 16-2; however, it is possible to obtain a strong sensor signal, because the sensor light is directly inputted to the light receiving fiber bundle 33 in case of absence of the weft.

Further, in this embodiment, since the weft can be detected when the sensor light emitted from the upper side fibers is shut out by the weft, an ordinary amplifier is used in place of the inversion amplifier 42 shown in FIG. 8. That is to say, in the case of the absence of the weft, a H-voltage level signal is directly given to one of the input terminals of the AND gate 43.

The operaion and the effect of this third embodiment are quite the same as in the first or second embodiment, which have already been explained with reference to FIGS. 8, 9 and 10.

Figure 13:
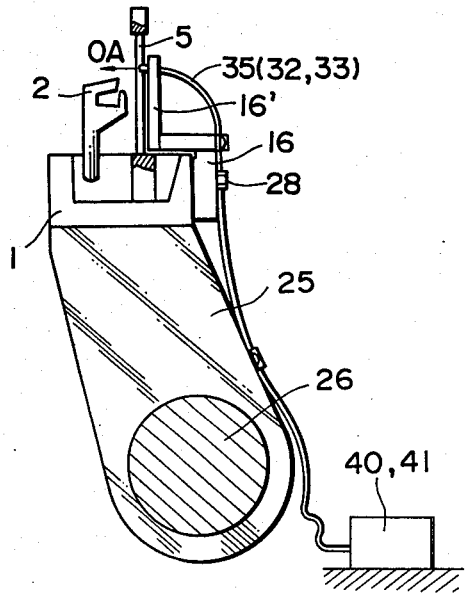
FIG. 13 is a partially sectional diagramatic side view of the essential portion of a reed, at which the fourth embodiment of the optical weft sensor according to the present invention is mounted.

FIG. 13 shows a fourth embodiment of the optical weft sensor according to the present invention. In this embodiment, the sensor holder 16 is fixed to the rear side surface of the reed holder 1 with a bolt 28.

The projection portion 16' connected integrally with the sensor holder 16 is placed behind the reed 5 extending upward in parallel with the reed wires. The bundle 30 of light emitting and receiving optical fibers 32 and 33 is passed through the hole formed in the projection portion 16' beng protected by a metal pipe 35, with the open end surface of the optical fiber bundle facing frontward and with the optical axis OA preset roughly perpendicular to the reed wires.

Therefore, the light emitted from the light emitting fibers 32 is reflected from a weft and is received by the light receiving fibers 33, so that the presence or absence of weft can be detected.

Figure 14A:
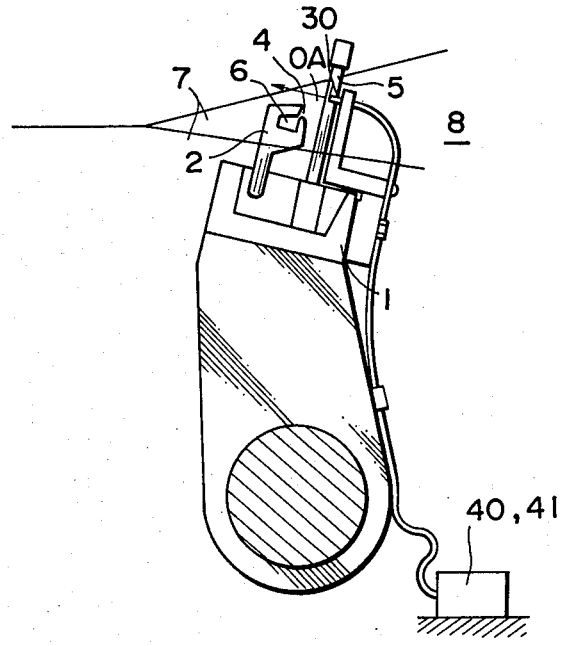
FIG. 14(A) is a diagramatic side view of the essential portion of a reed and the fourth embodiment of the optical weft sensor according to the present invention, in which the reed is positioned at the rearmost position.
Figure 14B:
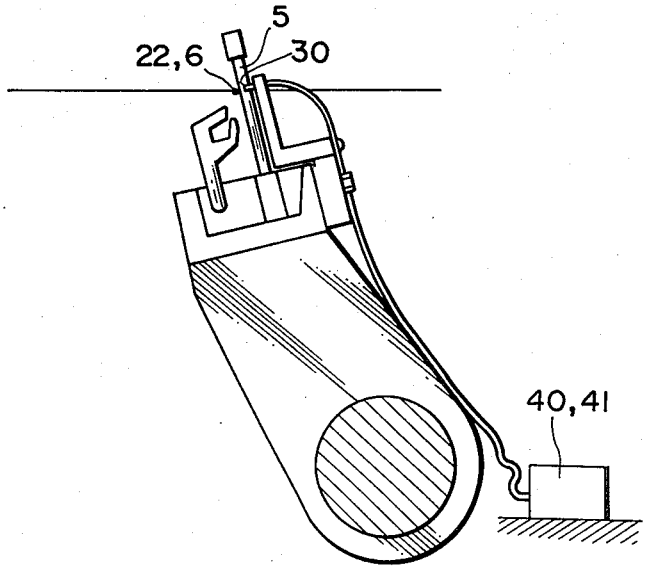
FIG. 14(B) is the same side view as in FIG. 14(A), in which the reed is positioned at the frontmost position.

FIGS. 14(A) and 14(B) show the mutual positions of the reed 5, air-guide plate 2, warp threads 7, weft 6, etc. in the fourth embodiment.

In FIG. 14(A), when the reed 5 is moved to the rearmost position, the air-guide plates 2 are advanced into the shed 8 formed between warp threads 7 and a weft 6 is inserted into the opening of the air-guide plates 2. In this state, the weft 6 is away from the optical axis OA of the optical fiber bundle 30; therefore, the presence or absence of weft is not detected.

After the weft 6 has been inserted into the shed 8, as shown in FIG. 14(A), the reed 5 moves frontward (leftward in FIG. 4) for performing beat-up motion. In this case, the weft is first removed through the weft-removing slot 4 of the air-guide plate 2 and is brought into contact with the reed wires of the reed 5. When the reed 5 further moves frontward, the weft 6 is moved by the reed wires and is beaten up to the cloth fell 22 as shown in FIG. 14(B).

Since the weft 6 is positioned near the open end surface of the optical sensor bundle 30 at the end stage of beat-up motion; that is, positioned on the optical axis OA of the sensor while the weft 6 is in contact with the reed 5, the light emitted from the sensor open end surface is reflected from the weft 6 and is received through the sensor open end surface, so that the presence of the weft 6 can be detected.

Figure 15:
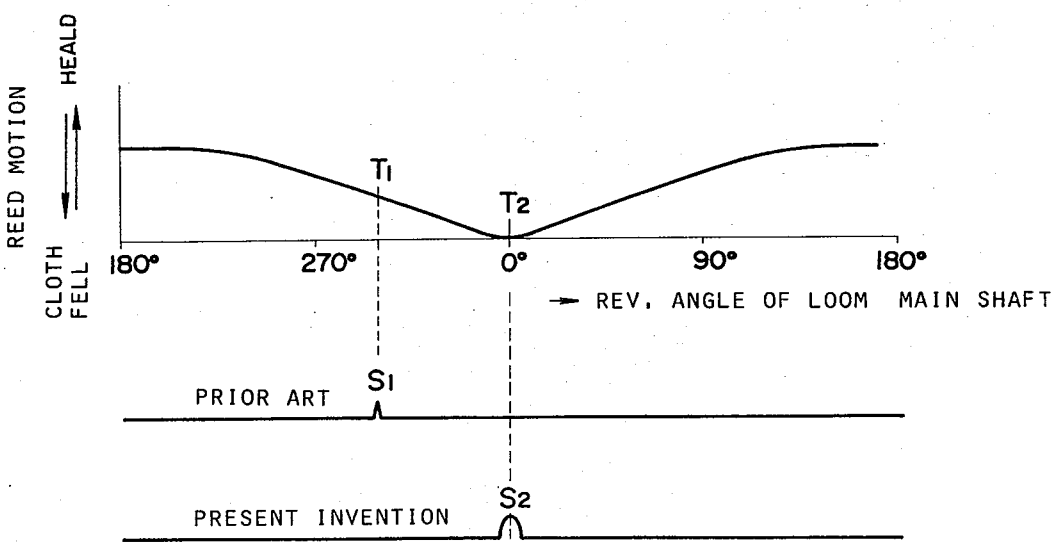
FIG. 15 is a graphical representation which illustrates the relationships between the detection signal $S_2$ from the fourth embodiment of the optical weft sensor according to the present invention and the movement of the reed, in comparison with the sensor signal $S_1$ obtained by the prior-art optical weft sensor.

FIG. 15 shows the relationships between sensor signal $S_2$ and the reed motion or the loom motion.

as depicted in the figure, the reed is being oscillated by the sley sword shaft with the shaft as its center, the speed of the reed becomes at its minimum (inflection points), that is, zero at the rearmost position (heald side) and the frontmost position (cloth fell side). Therefore, the speed of the weft 6 moving up and down in contact with and with respect to the reed wires becomes at its minimum at the cloth fell.

In the prior-art weft sensor, since the weft 6 is detected when being removed through the weft-removing slot, for instance, at the time $t_1$ in FIG. 15, the weft speed is relatively high and, therefore, the prior-art sensor signal $S_1$ is small with a short pulse width.

In contrast with this, in the present invention, since the weft 6 is detected when the weft is in contact with the reed wires and beaten up to the cloth fell at the time $T_2$ (at the end stage of the beat-up motion) in FIG. 15, the weft speed is almost zero and, therefore, the detection time period is long and therefore the sensor signal $S_2$ is relatively large with a large pulse width, thus improving reliability in weft detection.

Further, in this fourth embodiment, although the light emitting and receiving optical fibers are bundled into a single metal pipe, that is, a reflection-type optical weft sensor is described, it is of course possible to adopt a shut-out type optical weft sensor in which the light-emitting fibers are disposed on the rear side of the reed and the light-receiving fibers are disposed on the cloth fell side or vice versa.

Further, when the width of woven cloth is required to change, since it is possible to easily move the sensor holder 16 along the rear side surface of the reed holder 1 to an appropriate sensor position between the warp threads farmost from the opposite to the weft picking side and the catch-cord yarns, the setup work is simple without adjusting the air-guide plate position.

FIG. 16 shows a fifth embodiment of the optical weft sensor according to the present invention. In this embodiment, the sensor holder 16 is fixed to the front side surface of the reed holer 1 with a bolt 28. The projection portion 16' is passed through between the two air-guide plates 2 extending along the top surface of the air-guide holder 12 and to near the lower portion of one of the air-guide plates 2 and bending obliquely toward the weft-removing slot 4. The bundle of light emitting and receiving optical fibers is passed through the hole formed in the sensor holder (projection portion 16') being protected by a metal pipe 35, with the open end surface of the optical fiber bundle facing the weft-removing slot 4.

Therefore, the light emitted from the light emitting fibers is reflected from a weft when the weft passes through the slot 4 and is received by the light receiving fibers for detection of the presence or absence of weft.

In this embodiment, since the optical sensor is disposed at a position lower than the height of the weft-removing slot 4, the optical sensor will not interfere with the movement of the weft when the weft is removed through the slot 4.

Further, when the width of woven cloth is required to change, since it is possible to easily remove the sensor holder 16 and set it again to an appropriate sensor position between the warp threads farmost from and opposite to the weft picking side and the catch-cord yarns, the setup work is simple without adjusting the air-guide plate position.

FIG. 17 shows an sixth embodiment of the optical weft sensor according to the present invention. In this embodiment, the sensor holder 16 is fixed to the front surface of the reed holder 1 with a bolt 28. The bundle 30 of light emitting and receiving optical fibers 32, 33 extends in the shape of a 90° are to near the weft-removing slot 4, with the open end surface of the optical fiber bundle facing horizontally.

In this embodiment, it is possible to detect the weft by disposing the sensor bundle 30 on top of one of the air-guide plate 2 to detect the weft being removed through the weft removing slot 4.

The light emitted from the light emitting fibers is reflected from the weft passing through the weft removing slot and is received by the light receiving fibers for detection of the presence or absence of weft.

In this embodiment, since the optical sensor is disposed near the weft-removing slot 4, the optical sensor will not interfere with the movement of the weft removed through the slot 4. Further, the sensor holder 16 can readily be adjusted to an appropriate position by removing only the bolt 28 and by sliding the holder 16 along the reed holder 1 to an appropriate position between the warp threads farmost from and opposite to the weft picking side and the catch-cord yarns, without adjusting the air-guide plates when the width of woven cloth is required to change.

In this embodiment, since the optical weft sensor always detects the weft from the front side without detecting the cloth fell or the preceding weft already beaten-up to the cloth fell, it is possible to determine the width of the timing signal outputted from the proximity switch to be large, thus improving the detection reliability.

FIG. 18 shows a seventh embodiment of the optical weft sensor according to the present invention. In this embodiment, the sensor holder 16 is fixed to the front surface of the reed holder 1 with a bolt 28. The projection portion 16' connected integrally with the sensor holder 16 is passed through between the two air-guide plates 2 extending along the top surface of the air-guide holder 12 and near to the reed wires and bending vertically to near the weft-removing slot 4 of one of the air-guide plates 2. The bundle 30 of light emitting and receiving optical fibers is passed through the hole formed in the sensor holders 16 and 16' being protected by a metal pipe, with the open end surface of the optical fiber bundle facing the weft-removing slot 4.

Therefore, the light emitted from the light emitting fibers is reflected from a weft passing through the weft-removing slot and is received by the light receiving fibers for detection of the presence or absence of weft.

In this embodiment, since the optical sensor is disposed at a position lower than the height of the weft-removing slot 4, the optical sensor will not interfere with the movement of the weft removed through the slot 4. Further, the sensor holder 16 can readily be adjusted to an appropriate position by removing only the bolt 28 and by setting the holder 16 again to an appropriate position between the warp threads farmost from and opposite to the weft picking side and the catch-cord yarns, without adjusting the air-guide plates, when the width of woven cloth is required to change.

Figure 19:
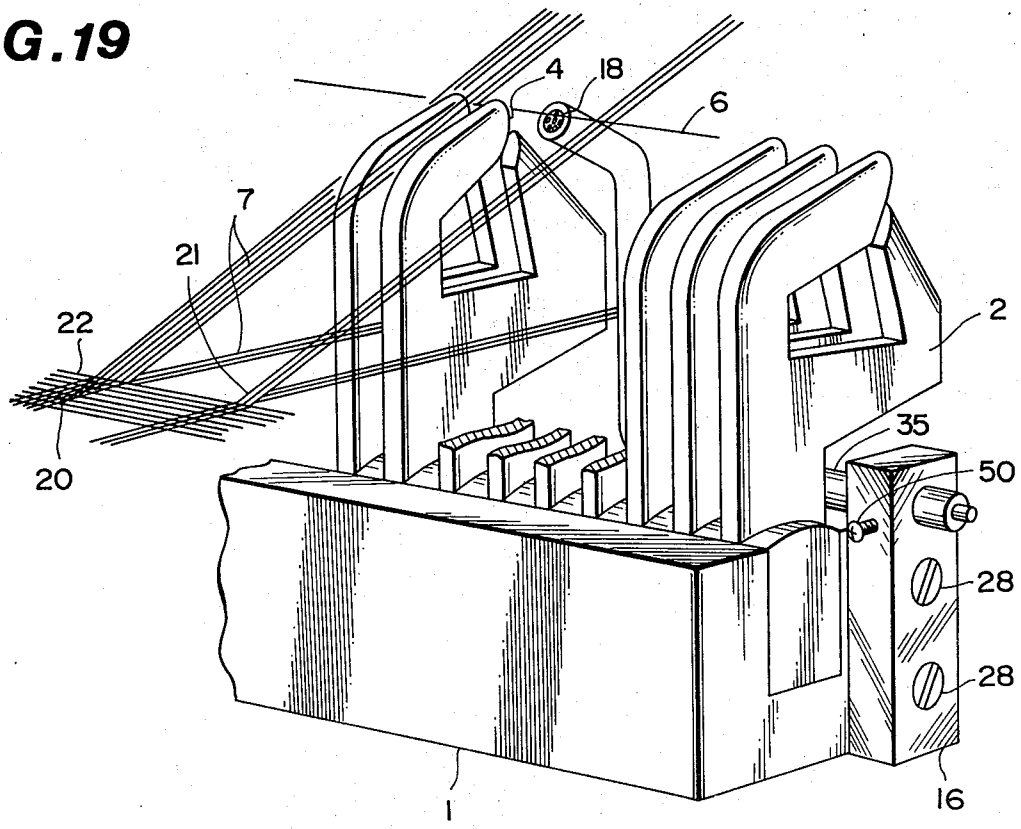
FIG. 19 is a perspective essential portion of a loom, at which an eighth embodiment of the optical weft sensor according to the present invention is mounted.

FIG. 19 shows an eighth embodiment of the optical weft sensor according to the present invention. In this embodiment, the sensor holder 16 is fixed to the side end surface of the reed holder 1 with two bolts 28, a L-shaped metal pipe 35 is passed through a hole formed in the sensor holder 16, and the metal pipe 35 is fixed by a screw 50. The metal pipe 35 extends between the air-guide plates 2 and the reed frame (not shown) and bends vertically to near the weft-removing slot 4 of one of the air-guide plates. The bundle of light emitting and receiving optical fibers is passed through the metal pipe 35, with the open end surface 18 of the optical fiber bundle facing the weft-removing slot 4.

Therefore, the light emitted from the light emitting fibers is reflected from a weft passing through the weft-removing slot and is received by the light-receiving fibers for detection of the presence or absence of weft.

In this embodiment, since the optical sensor is disposed at a position lower than the height of the weft-removing slot 4, the optical sensor will not interfere with the movement of the weft removed through the slot 4. Further, the open end surface 18 of the optical fiber bundle can readily be adjusted to an appropriate position by loosening and fastening only the screw 50 when the width of woven coth is required to change.

This embodiment is convenient, in particular, when the gap between the air-guide plates is too small to dispose the sensor holder therebetween.

As described above, in the optical weft sensor for a loom according to the present invention, since the sensor is supported by one or two sensor holders so as to be adjustable along the reed frame or the reed holder, since the optical axis is set to be near and in parallel with the reed wires or in the direction in which the weft moves from the weft removing slot to a position where the weft is in contact with the reed wires at the start stage of the beat-up motion or toward a position where the weft is in contact with the reed wires at the end stage of the beat-up motion, since the weft sensor is arranged below or away from the weft-removing slot of the air-guide plate, and since the LED and the phototransistor are fixed on the loom frame without application of shock or vibration to these elements, it is possible to attain the following practical advantages:

(1) The weft-detecting time period is relatively long;
(2) The sensor can readily be adjusted when the width of woven cloth is required to change by removing only the bolts fastening the sensor holder without adjusting the air-guide plates;
(3) The weft will not interfere with the sensor; and
(4) The life time of the electronic elements is long.

Accordingly, it is possible to improve reliability in weft detection, to simplify setup work (loom setting work before weaving a cloth) for the loom, and to prevent wale streak in woven cloth.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. An optical weft sensor for a loom with a frame for detecting the presence of a weft inserted into a shed formed by warp threads before the weft is beaten-up during a beat-up stage by a reed having reed wires arranged in a reed frame fixed to a reed holder, which comprises:

(a) light emitting means fixed to the frame of the loom for emitting weft-sensing light;
(b) light receiving means fixed to the frame of the loom for receiving the light emitted from said light emitting means and influenced by the presence of the weft;
(c) a first optical fiber optically connected to said light emitting means for transmitting the emitted light therethrough;
(d) a second optical fiber optically connected to said light receiving means for transmitting the received light therethrough;
(e) optical signal processing means responsive to said light receiving means for processing the light received through said second optical fiber to stop the loom in case a weft is not inserted into the shed;
(f) means for holding said first and second optical fibers, the open end surfaces of said optical fibers and said holding means being disposed out of the range within which the weft is relatively moved with respect to the reed at the beat-up stage; and
(g) means for adjusting the position of the open end surfaces of said optical fibers along the longitudinal direction of the reed when the width of woven cloth is required to change.

2. An optical weft sensor for a loom as set forth in claim 1, wherein said fiber holding means and said position adjusting means are a U-shaped member adjustably mounted on top of the reed frame for holding said first and second optical fibers to transmit the emitted light and received light in such a direction that the optical axis thereof is near and in parallel with the reed wires and in such a way that the sensor light is emitted from top to bottom along the reed wires and the light reflected from a weft is received near the top of the reed frame.

3. An optical weft sensor for a loom as set forth in claim 1, wherein said position adjusting means is a holder block adjustably mounted on the front side surface of the reed holder, and said fiber holding means is a projection fixed to said holder block for holding said optical fibers to transmit the emitted light and received light in such a direction that the optical axis thereof is near and in parallel with the reed wires and in such a way that the sensor light is emitted from bottom to top along the reed wires and the light reflected from a weft is received at the bottom of the reed frame.

4. An optical weft sensor for a loom as set forth in claim 1, wherein said first fiber holding and position adjusting means is a U-shaped member adjustably mounted on top of the reed frame, for holding said first optical fiber to transmit the emitted light in such a direction that the optical axis is near and in parallel with the reed wires and in such a way that the sensor light is emitted from top to bottom along the reed wires, and said second position adjusting means is a holder block adjustably mounted on the front side surface of the reed holder and said second fiber holding means is a projection fixed to said holder block for holding said second optical fiber to transmit the received light in such a direction that the optical axis thereof coincides with that of said first optical fiber to transmit the emitting light and in such a way that the sensor light shut-out by a weft is received at the bottom of the reed frame.

5. An optical weft sensor for a loom as set forth in claim 1, wherein said first position adjusting means is a holder block adjustably mounted on the front side surface of the reed holder and said first fiber holding means is a projection fixed to said holder block for holding said first optical fiber to transmit the emitter light in such a direction that the optical axis thereof is near and in parallel with the reed wires and in such a way that the sensor light is emitted from bottom to top along the reed wires, and said second fiber holding and position adjusting means is a U-shaped member adjustably mounted on top of the reed frame for holding said second optical fiber to transmit the received light in such a direction that the optical axis thereof coincides with that of said first optical fiber to transmit the emitted light and in such a way that the sensor light shut-out by a weft is received at the top of the reed frame.

6. An optical weft sensor for a loom as set forth in claim 1, wherein said position adjusting means is a holder block adjustably mounted on the rear side surface of the reed holder, and said fiber holding means is an L-shaped member fixed to said holder block for holding said optical fibers to transmit the emitted light and received light perpendicular to the reed wires in such a position where the optical axis perpendicular to the open end surface of the bundle of said optical fibers points at the weft brought into contact with the reed wires at the end stage of the weft beat-up motion and in such a way that the sensor light is emitted frontward from the reed side and the light reflected from the weft is received on the reed side.

7. An optical weft sensor for a loom as set forth in claim 1, wherein said position adjusting means is a holder block adjustably mounted on the front side surface of the reed holder, and said fiber holding means is a roughly L-shaped member fixed to said holder block for holding said optical fibers to transmit the emitted light and received light obliquely in such a position that the optical axis perpendicular to the open end surface of the bundle of said optical fibers points at a slot of one of air-guide plates and in such a way that the sensor light is emitted obliquely and upwardly toward the reed wires from the front side of the reed holder and the light reflected from the weft is received on the front side of the reed holder.

8. An optical weft sensor for a loom as set forth in claim 1, wherein said position adjusting means is a holder block adjustably mounted on the front side surface of the reed holder for holding said optical fibers to transmit the emitter light and received light in such a position that the optical axis perpendicular to the open end surface of said optical fibers points at the weft being removed or removed from a slot of one of air-guide plates and in such a way that the sensor light is emitted nearly horizontally toward the reed wires from the front side of the reed holder and the light reflected from a weft is received on the front side of the reed holder.

9. An optical weft sensor for a loom as set forth in claim 1, wherein said position adjusting means is a holder block adjustably mounted on the front side surface of the reed holder and said fiber holding means is an L-shaped member fixed to said holder block for holding said optical fibers to transmit the emitted light and received light obliquely in such a position where the optical axis perpendicular to the open end surface of the bundle said optical fibers points at a slot of one of air-guide plates and in such a way that the sensor light is emitted obliquely and upwardly from the rear and lower side of the air-guide plate and the light reflected from the weft is received on the rear side of the air-guide plate.

10. An optical weft sensor for a loom as set forth in claim 1, wherein said optical signal processing means comprises:

(a) a proximity switch for outputting a timing signal indicating that the weft comes to an appropriate position to be detected in synchronization with the motion of the loom;

(b) an AND gate one input terminal of which is responsive to said light receiving means and the other input terminal of which is responsive to said proximity switch, for outputting a signal indicative of absence of weft when said light receiving means does not output a signal indicative of presence of weft and said proximity switch outputs the timing signal; and (c) a relay connected to said AND gate for breaking a circuit to stop the loom in response to the signal outputted from said AND gate.

11. An optical weft sensor for a loom comprising:

light emitting means disposed on said loom at a location relatively free from vibration and shock for emitting weft-sensing light;

light receiving means disposed on said loom at a location relatively free from vibration and shock for receiving said weft-sensing light emitted by said light emitting means;

optical fiber means optically connected to said light emitting means for transmitting the emitted light therethrough and optically connected to said light receiving means for transmitting the received light therethrough;

optical signal processing means responsive to said light receiving means for generating an indication according to whether light is received through said optical fiber;

means for holding said optical fiber means, the open end surfaces of said optical fiber means and said holding means being disposed out of the range within which the weft is relatively moved with respect to a reed during a beat-up stage of operation of said loom; and means for adjusting the position of the open end surfaces of said optical fiber means along the longitudinal direction of the reed.

* * * * *